US005810358A

United States Patent [19]

Manson

[11] Patent Number: 5,810,358

[45] Date of Patent: Sep. 22, 1998

[54] TRAFFIC SIGN LEARNING GAME

[76] Inventor: Wentworth B. Manson, Richville Dr., P.O. Box FH14013, Nassau, Bahamas

[21] Appl. No.: 851,218

[22] Filed: May 5, 1997

[51] Int. Cl.[6] ..... A63F 3/00

[52] U.S. Cl. ..... 273/251

[58] Field of Search ..... 273/251, 252, 273/254

[56] References Cited

U.S. PATENT DOCUMENTS

| | | | |
|---|---|---|---|
| 4,067,579 | 1/1978 | Boofer | 273/254 |
| 4,094,510 | 6/1978 | Drohomirecky | 273/251 |
| 4,216,966 | 8/1980 | Mac Rae | 273/243 |
| 4,953,871 | 9/1990 | Antwi | 273/252 |
| 5,048,841 | 9/1991 | Manney et al. | 273/246 |
| 5,108,111 | 4/1992 | Bilodeau | 273/249 |
| 5,282,630 | 2/1994 | Dupuis, Jr. | 273/252 |

FOREIGN PATENT DOCUMENTS

| | | | |
|---|---|---|---|
| 1258914 | 12/1971 | United Kingdom | 273/251 |
| 1411374 | 10/1975 | United Kingdom | 273/254 |

*Primary Examiner*—Benjamin H. Layno
*Attorney, Agent, or Firm*—Richard L. Miller, P.E.

[57] ABSTRACT

A board game that teaches the meanings of traffic signs in a manner which is interesting by incorporating the traffic signs and their meanings into a race game. The game includes a game board, a plurality of playing pieces, and a deck of cards. The game board has a path thereon. The plurality of playing pieces are movable along the path on the game board and represent the players of the game. The deck of cards has instruction indica thereon for instructing the movement of the plurality of playing pieces along the path on the game board. And, the path on the game board is divided into a plurality of spaces, each of which representing a street block and having a traffic sign with its meaning depicted thereon, so that as each player draws a card from the deck of cards and reads the instruction indicia thereon, the player moves its playing piece in accordance therewith and stops at a street block where the player learns the meaning of the traffic sign associated therewith.

3 Claims, 4 Drawing Sheets

| Ref No. | Sign Posted | | Ref No. | Sign Posted | |
|---|---|---|---|---|---|
| A | 25 MPH MAXIMUM SPEED LIMIT |   | H | NO RIGHT TURN |  |
| B | 35 MPH MAXIMUM SPEED LIMIT |   | I | NO LEFT TURN |  |
| C | NO ENTRY |  | J | U TURN |  |
| D | NO WAITING |  | K | YIELD RIGHT OF WAY |   |
| E | CHILDREN |  | L | STOP AND GIVE WAY |   |
| F | PEDESTRIAN CROSSING |  | M | TURN RIGHT |  |
| G | ROAD WORK |  | | | |

| Ref No. | Sign Posted |
|---|---|
| N | TURN LEFT |
| O | ADVANCE WARNING OF NO THROUGH ROAD |
| P | ONE-WAY STREET |
| Q | SHARP DEVIATION OF ROUTE TO RIGHT |
| R | NO LEFT TURN |
| S | NO PARKING |
| T | 25 MPH MAXIMUM SPEED LIMIT (SPEED LIMIT 25) |

| Ref No. | Sign Posted |
|---|---|
| U | TRAFFIC SIGNAL |
| V | 35 MPH MAXIMUM SPEED LIMIT (SPEED LIMIT 35) |
| W | KEEP LEFT |
| X | AHEAD ONLY |
| Y | DO NOT ENTER (DO NOT ENTER) |
| Z | FINISH |

FIG 1B 20
22
24
26
28
30
40

TRAFFIC SIGN LEARNING GAME

BACKGROUND OF THE INVENTION

1. Field of the Invention

The present invention relates to a board game. More particularly, the present invention relates to a board game that teaches the meanings of traffic signs.

2. Description of the Prior Art

There are known board games in which players sequentially move playing pieces around a simulated race course in a race to the finish.

Numerous innovations for board games have been provided in the prior art that will be described. Even though these innovations may be suitable for the specific individual purposes to which they address, however, they differ from the present invention.

FOR EXAMPLE, U.S. Pat. No. 4,216,966 to MacRae teaches a game board apparatus based on possible experiences of a player consuming liquor in relation to a time span in liquor establishments which includes a game board having a series of locations thereon and forming a playing path about the board. The liquor establishments are adjacent some of the playing locations. Player tokens are provided for moving on the playing locations and the stop locations. A pair of dice is used to move the player tokens about the playing and stop locations. A series of cards each bearing indicia indicating a type of drink, its liquor content, a message to the player, the amount of liquor consumed and the time spent during the consumption is provided. A blood alcohol concentration level chart is provided which has time increments versus ounces of liquor for ascertaining a state of drunkenness. A display board is provided which includes a dial for recording elapsed time and a dial to record the amount of liquor consumed. The player token is provided with a removable rigid head to indicate sobriety which is replaced by a head which flexes to indicate drunkenness. A series of cards is provided on each of which is indicia stating possible consequences to a player who is drunk and lands on a road hazard playing location. A police car is also provided as a means of eliminating a drunken driver from the game. The police car is moved in either direction on the path by means of a pair of dice.

ANOTHER EXAMPLE, U.S. Pat. No. 5,048,841 to Mannry et al. teaches a racing board game apparatus for use by a plurality of players which comprises a game board having a simulated race course of depicted thereon, including a plurality of racing lanes, a plurality of playing pieces each representing a player for movement along the simulated race course, a random number generator for determining a sequential playing order to be followed by the players in turn, and cards for determining a plurality of potential movements of each playing piece at a given turn. Each of the racing lanes is divided into a plurality of discreet, sequential playing spaces and each racing lane is designated as one of the four suits in a standard deck of playing cards. The determining cards include at least one deck of standard playing cards to be distributed to and strategically discarded by the players throughout the course of a game for determining movements of the playing pieces along the simulated race course. A suite of each playing cards determines which lane a playing piece may be moved in, and a facial designation of each playing card determines a number of spaces by which a playing piece may be moved in a given lane.

STILL ANOTHER EXAMPLE, U.S. Pat. No. 5,108,111 to Bilodeau teaches a maze type game board having a plurality of pathways divided into spaces. Preselected spaces having directional indicators thereon so that a playing piece moving along the spaces when finishing a turn on the directional indicators must begin the next turn by moving off in the direction of the indicator. The object of the game being to travel from the start point to the finish point of the game. The players having the option of choosing the move the playing piece down any pathway forming a part of an intersection through which the players piece is moving.

FINALLY, YET ANOTHER EXAMPLE, U.S. Pat. No. 5,282,630 to Dupuis, Jr. teaches a car race game apparatus, which includes a playing board, marked to provide a system of interconnected branch roads. The road system is subdivided into multiple contiguous spaces, arranged between a START space and a FINISH space, such that each game player can move an individual token from space to space, in an effort to reach the FINISH space, before the other players. Selected spaces are marked, so that when a token lands on such spaces, the token has to be returned to a designated space near the START space. Also, a pack of direction cards is provided for directing a player to return his/her token back to a designated space, when the player's token passes through specially marked STOP spaces, located in immediate proximity to the branch road intersection points. The game is designed to introduce penalties into the play, so that even when a player's token is considerably behind the leading player's token, there is always a possibility that the leading player will be penalized, thereby enabling any of the other players to still win the game.

It is apparent that numerous innovations for board games have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Applicant has provided a board game that teaches the meanings of traffic signs in a manner which is interesting by incorporating these traffic signs into a race to the finish type of game.

ACCORDINGLY, AN OBJECT of the present invention is to provide a traffic sign learning game that avoids the disadvantages of the prior art.

ANOTHER OBJECT of the present invention is to provide a traffic sign learning game that is simple and inexpensive to manufacture.

STILL ANOTHER OBJECT of the present invention is to provide a traffic sign learning game that is simple to use.

BRIEFLY STATED, YET ANOTHER OBJECT of the present invention is to provide a board game that teaches the meanings of traffic signs in a manner which is interesting by incorporating the traffic signs and their meanings into a race game. The game includes a game board, a plurality of playing pieces, and a deck of cards. The game board has a path thereon. The plurality of playing pieces are movable along the path on the game board and represent the players of the game. The deck of cards has instruction indica thereon for instructing the movement of the plurality of playing pieces along the path on the game board. And, the path on the game board is divided into a plurality of spaces, each of which representing a street block and having a traffic sign with its meaning depicted thereon, so that as each player draws a card from the deck of cards and reads the instruction indicia thereon, the player moves its playing piece in accordance therewith and stops at a street block where the player learns the meaning of the traffic sign associated therewith.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows:

FIGS. 1A and 1B are is a chart indicating the traffic signs utilized in the present invention and the codes associated therewith;

Figure 1A:
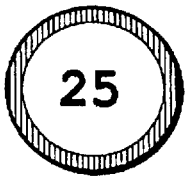
Figure 1A:
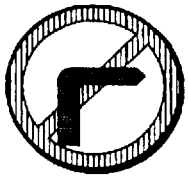
Figure 1A:
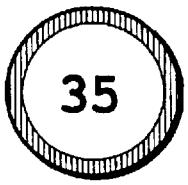
Figure 1A:
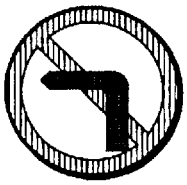
Figure 1A:
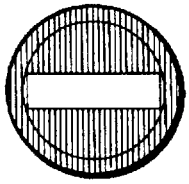
Figure 1A:
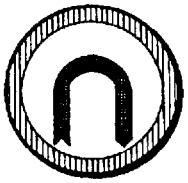
Figure 1A:
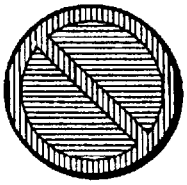
Figure 1A:
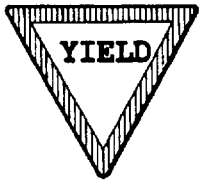
Figure 1A:
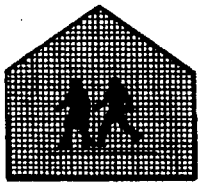
Figure 1A:
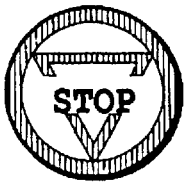
Figure 1A:
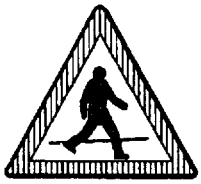
Figure 1A:
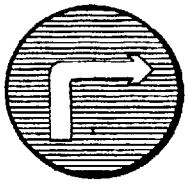
Figure 1A:
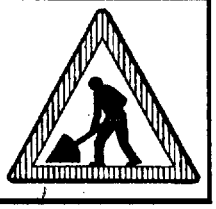

| LIST OF REFERENCE NUMERALS UTILIZED IN THE DRAWING | |
|---|---|
| A | 25 MPH maximum speed limit traffic sign |
| B | 35 MPH maximum speed limit traffic sign |
| C | No entry traffic sign |
| D | No waiting traffic sign |
| E | Children playing traffic sign |
| F | Pedestrian crossing traffic sign |
| G | Road work traffic sign |
| H | No right turn traffic sign |
| I | No left turn traffic sign |
| J | U turn traffic sign |
| K | Yield right of way traffic sign |
| L | Stop and give way traffic sign |
| M | Turn right traffic sign |
| N | Turn left traffic sign |
| O | Advance warning of no through road traffic sign |
| P | One-way street traffic sign |
| Q | Sharp deviation of route to right traffic sign |
| R | No left turn traffic sign |
| S | No parking traffic sign |
| T | 25 MPH maximum speed limit traffic sign |
| U | Traffic signal traffic sign |
| V | 35 MPH maximum speed limit traffic sign |
| W | Keep left traffic sign |
| X | Ahead only traffic sign |
| Y | Do not enter traffic sign |
| Z | Finish sign |
| 10 | game board |
| 12 | path |
| 14 | path elliptic-shaped peripheral portion |
| 16 | path peripheral portion first section |
| 18 | path peripheral portion start street block space |
| 20 | path first branch portion |
| 22 | path peripheral portion second section |
| 24 | path second branch portion |
| 26 | path third branch portion |
| 28 | path peripheral portion third section |
| 30 | path fourth branch portion |
| 31 | path peripheral portion fourth section |
| 32 | path fifth branch portion |
| 34 | path peripheral portion fifth section |
| 36 | path sixth branch portion |

DESCRIPTION OF THE PREFERRED EMBODIMENT

Referring now to the figures in which like numerals indicate like parts, and particularly to FIGS. 1A and 1B, the traffic signs whose meanings are learned during the course of the game of the present invention and the codes associated therewith are shown, and further reflected in the following table 1.

TABLE 1

| Reference Number | Traffic Sign Posted and Meaning |
|---|---|
| A | 25 MPH Maximum Speed Limit |
| B | 35 MPH Maximum Speed Limit |
| C | No Entry |
| D | No Waiting |
| E | Children Playing |
| F | Pedestrian Crossing |
| G | Road Work |
| H | No Right Turn |
| I | No Left Turn |
| J | U Turn |
| K | Yield Right Of Way |
| L | Stop And Give Way |
| M | Turn Right |
| N | Turn Left |
| O | Advance Warning Of No Through Road |
| P | One-Way Street |
| Q | Sharp Deviation Of Route To Right |
| R | No Left Turn |
| S | No Parking |
| T | 25 MPH Maximum Speed Limit |
| U | Traffic Signal |
| V | 35 MPH Maximum Speed Limit |
| W | Keep Left |
| X | Ahead Only |
| Y | Do Not Enter |
| Z | Finish |

Figure 2A:
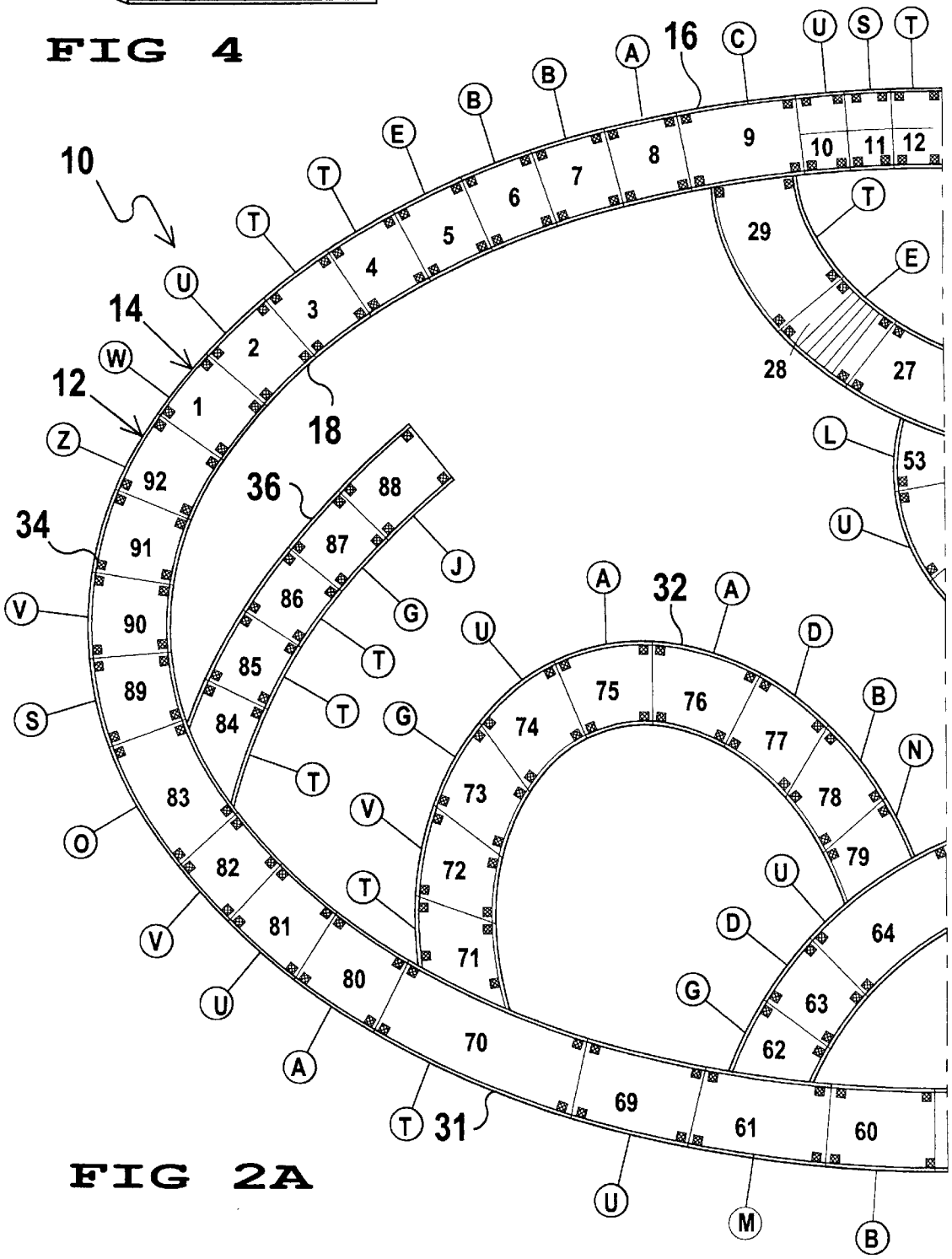
FIG. 2A is a top plan view of the left side portion of the game board of the present invention.
Figures 2B, 3:
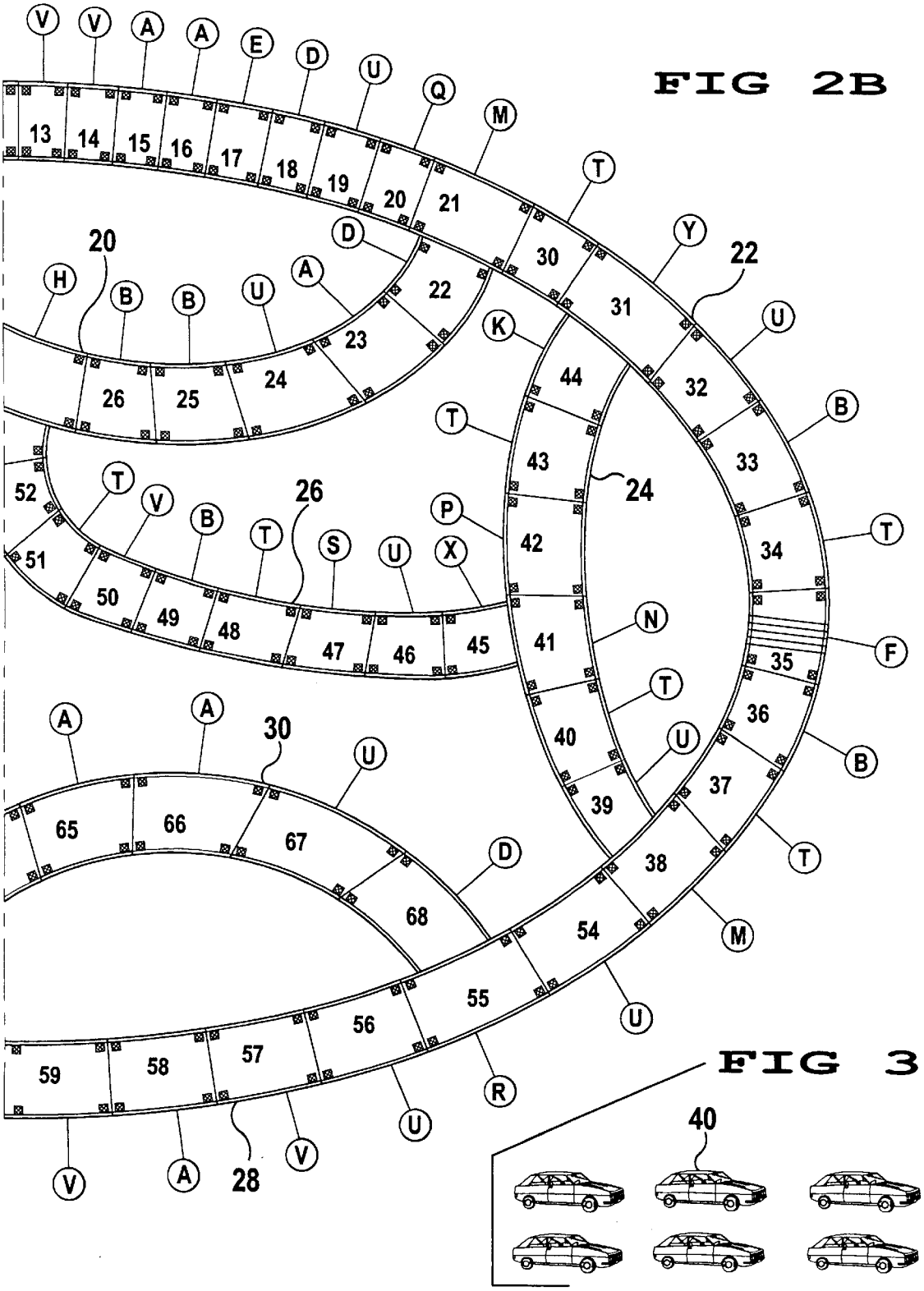
FIG. 2B is a top plan view of the right side portion of the game board of the present invention.
FIG. 3 is a diagrammatic perspective view of the playing pieces of the present invention.

As shown in FIGS. 2A and 2B, the game of the present invention includes a game board 10 that has a path 12 thereon that is divided into 92 spaces each of which representing a street block and having a particular traffic sign associated therewith.

The particular traffic sign associated with each space of the 92 spaces of the path 12 on the game board 10 is represented by a corresponding reference number A through Z, as indicated in either FIGS. 1A and 1B, or table 1, supra. It is to be understood, however, that the use of the reference numbers A through Z is for explanation purposes only and that the actual game board 10 has the actual traffic signs and their meanings depicted thereon so as to allow the players to learn the meanings of the traffic signs associated with the street blocks as they traverse the path 12.

The path 12 includes a path elliptic-shaped peripheral portion 14 that has a path peripheral portion first section 16 that originates with a path peripheral portion start street block space 18 from which the game begins and with 21 street block spaces extending clockwise therefrom which are numbered 1 to 21 only for ease of explaining the configuration of the path 12 and not actually depicted on the game board 10.

The path 12 further includes a path first branch portion 20 that extends inwardly from right to left from street block space 21 of the path peripheral portion first section 16 of the path elliptic-shaped peripheral portion 14 of the path 12 to street block space 9 of the path peripheral portion first section 16 of the path elliptic-shaped peripheral portion 14 of the path 12, and is divided into 8 street block spaces that are numbered 22 to 29 again only for ease of explaining the configuration of the path 12 and again not actually depicted on the game board 10.

The path elliptic-shaped peripheral portion 14 of the path 12 further includes a path peripheral portion second section 22 that extends clockwise from street block space 21 of the path peripheral portion first section 16 of the path elliptic-shaped peripheral portion 14 of the path 12, and is divided into 9 street block spaces that are numbered 30 to 38 again only for ease of explaining the configuration of the path 12 and again not actually depicted on the game board 10.

The path 12 further includes a path second branch portion 24 that extends inwardly from front to back from street block space 38 of the path peripheral portion second section 22 of the path elliptic-shaped peripheral portion 14 of the path 12 to street block space 31 of the path peripheral portion second section 22 of the path elliptic-shaped peripheral portion 14 of the path 12, and is divided into 6 street block spaces that are numbered 39 to 44 again only for ease of explaining the configuration of the path 12 and again not actually depicted on the game board 10.

The path 12 further includes a path third branch portion 26 that extends inwardly from right to left from street block space 41 of the path second branch portion 24 of the path 12 to street block space 27 of the path first branch portion 20 of the path 12, and is divided into 9 street block spaces that are numbered 45 to 53 again only for ease of explaining the configuration of the path 12 and again not actually depicted on the game board 10.

The path elliptic-shaped peripheral portion 14 of the path 12 further includes a path peripheral portion third section 28 that extends clockwise from street block space 38 of the path peripheral portion second section 22 of the path elliptic-shaped peripheral portion 14 of the path 12, and is divided into 8 street block spaces that are numbered 54 to 61 again only for ease of explaining the configuration of the path 12 and again not actually depicted on the game board 10.

The path elliptic-shaped peripheral portion 14 of the path 12 further includes a path peripheral portion fourth section 31 that extends clockwise from street block space 61 of the path peripheral portion third section 28 of the path elliptic-shaped peripheral portion 14 of the path 12, and is divided into 2 street block spaces that are numbered 69 to 70 again only for ease of explaining the configuration of the path 12 and again not actually depicted on the game board 10.

The path 12 further includes a path fourth branch portion 30 that extends inwardly from left to right from street block space 61 of the path peripheral portion third section 28 of the path elliptic-shaped peripheral portion 14 of the path 12 to street block space 55 of the path peripheral portion third section 28 of the path elliptic-shaped peripheral portion 14 of the path 12, and is divided into 7 street block spaces that are numbered 62 to 68 again only for ease of explaining the configuration of the path 12 and again not actually depicted on the game board 10.

The path 12 further includes a path fifth branch portion 32 that extends inwardly from left to right from street block space 70 of the path peripheral portion fourth section 31 of the path elliptic-shaped peripheral portion 14 of the path 12 to street block space 64 of the path fourth branch portion 30 of the path 12, and is divided into 9 street block spaces that are numbered 71 to 79 again only for ease of explaining the configuration of the path 12 and again not actually depicted on the game board 10.

The path elliptic-shaped peripheral portion 14 of the path further includes a path peripheral portion fifth section 34 that extends clockwise from street block space 70 of the path peripheral portion fourth section 31 of the path elliptic-shaped peripheral portion 14 of the path 12 to street block space 1 of the path peripheral portion first section 16 of the path elliptic-shaped peripheral portion 14 of the path 12, and is divided into 8 street block spaces that are numbered 80 to 92 again only for ease of explaining the configuration of the path 12 and again not actually depicted on the game board 10, and with street block space 92 being the finish.

The path 12 further includes a path sixth branch portion 36 that extends inwardly from front to back from street block space 83 of the path peripheral portion fifth section 34 of the path elliptic-shaped peripheral portion 14 of the path 12, and is divided into 5 street block spaces that are numbered 84 to 88 again only for ease of explaining the configuration of the path 12 and again not actually depicted on the game board 10.

As shown in FIG. 3, the game of the present invention further includes a plurality of playing pieces 40, each of which representing a player and being movable along the path 12 on the game board 10.

Figure 4:
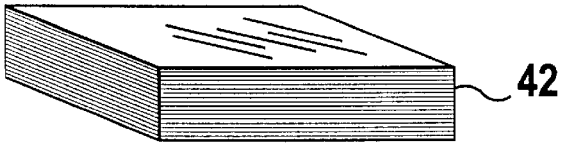
FIG. 4 is a diagrammatic perspective view of the deck of cards of the present invention.

As shown in FIG. 4, the game of the present invention further includes a deck of cards 42 constituting 80 cards, each of which having indica thereon for instructing the movement of the plurality of playing pieces 40 along the path 12 on the game board 12. The breakdown of the deck of cards 42 and the instruction indica thereon is reflected in the following table 2.

TABLE 2

| Number of Cards | Instruction Indica |
|---|---|
| 6 | If in a 35 MPH speed zone, drive two street blocks |
| 5 | Drive to second 35 MPH Maximum Speed Limit sign, if none drive one street block |
| 4 | Drive to third 35MPH Maximum Speed Limit sign, if none drive two street blocks |
| 4 | If in a 35 MPH speed zone, stop at first 25 MPH Maximum Speed Limit sign |
| 2 | If in a 35 MPH speed zone, drive three street blocks |
| 1 | Drive to second 35 MPH Maximum Speed Limit sign, if none drive two street blocks |
| 5 | Drive to first 35 MPH Maximum Speed Limit sign |
| 6 | Drive to first 25 MPH Maximum Speed Limit sign |
| 5 | Drive to second 25 MPH Maximum Speed Limit sign |
| 3 | Drive to third 25 MPH Maximum Speed Limit sign |
| 4 | Drive to third 25 MPH Maximum Speed Limit sign, if none drive two street blocks |
| 2 | If in a 25 MPH speed zone, drive three street blocks |
| 5 | Drive to third 25 MPH Maximum Speed Limit sign, if none drive one street block |
| 4 | Drive to second 25 MPH Maximum speed Limit sign, if none drive one street block |
| 5 | Drive three street blocks and stop |
| 2 | If in a 25 MPH speed zone, drive three street blocks |
| 3 | If in a 25 MPH speed zone, drive |

TABLE 2-continued

| Number of Cards | Instruction Indica |
|---|---|
| | three street blocks and stop, else drive two street blocks |
| 8 | Drive one street block and stop |
| 6 | Drive two street blocks and stop |

As each player picks a card from the deck of cards 42, and moves the playing piece 40 according to the instruction indica thereon, certain rules apply which must be followed and which are reflected in the following table 3.

TABLE 3

| Rule Number | Rule |
|---|---|
| 1 | if a playing piece stops at a street block having a stop light associated therewith, the player associated with the playing piece misses two turns unless all playing pieces are simultaneously stopped there |
| 2 | If a player picks a card indicating drive two street blocks and the playing piece lands on a street block space having a school zone, pedestrian crossing, or children playing sign associated therewith, the playing piece must go back to the previous street block having a stop light associated therewith |
| 3 | If a playing piece lands on a street block having a no parking or no waiting sign associated therewith, the playing piece must go back to start unless all playing pieces have simultaneously landed there |
| 4 | If a playing piece lands on a street block having a road work sign associated therewith, the player associated with the playing piece misses one turn unless all playing pieces have simultaneously landed there |
| 5 | If a playing piece lands on a curve, the player associated with the playing piece must wait to pick a card indicating drive one, two, or three street blocks before moving the playing piece again |
| 6 | If a playing piece passes through a street block having a no through road sign associated therewith, the playing piece must move past the road sign, stop, and turn around |
| 7 | If a playing piece stops one street block from the finish sign, the player associated with the playing piece cannot move the playing piece until picking a card indicating drive one street block |
| 8 | If a playing piece stops two street blocks from the finish sign, the player associated with the playing piece cannot move the playing piece until picking a card indicating drive two blocks |
| 9 | If a playing piece stops on any turn sign, the player associated with said playing piece moves his playing piece in accordance with directions on respective turn sign |

It will be understood that each of the elements described above, or two or more together, may also find a useful application in other types of constructions differing from the types described above.

While the invention has been illustrated and described as embodied in a traffic sign learning game, however, it is not limited to the details shown, since it will be understood that various omissions, modifications, substitutions and changes in the forms and details of the device illustrated and its operation can be made by those skilled in the art without departing in any way from the spirit of the present invention.

without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A traffic sign learning game playable by players, comprising:

a) a game board having a path thereon;

b) a plurality of playing pieces movable along same said path on said game board and representing the players of said traffic sign learning game; and c) a single deck of cards for all players, each having instruction indica thereon for instructing the only movement of said plurality of playing pieces along said path on said game board;

wherein said path on said game board being divided into a plurality of spaces, each of which representing a street block and having a traffic sign with indicia of its meaning depicted thereon, with each player learning the meaning of said traffic sign associated with said street block said playing piece of said plurality of playing pieces lands upon when moved thereto by the player in accordance with the instruction indicia on a card from said single deck of cards drawn by the player; said path including an elliptic-shaped peripheral portion being continuous and non-ending and having a first section originating with a single start space for use by all players from which said traffic sign learning game begins and having 21 spaces extending clockwise therefrom; said path further including a first branch extending inwardly from right to left from, and forming with, the twenty first space of said first section of said elliptic-shaped peripheral portion of said path a first junction, to, and forming with, the ninth space of said first section of said elliptic-shaped peripheral portion of said path a second junction, and being divided into 8 spaces; said first junction space having a "TURN RIGHT" traffic sign with corresponding indicia of its meaning depicted thereon forcing the player who lands thereon to turn right from said elliptic-shaped peripheral portion of said path and enter said first branch which further reenforces the meaning of the traffic sign by having the player not only see the sign and its meaning, but also physically carry out its instruction; said second junction space having a "NO ENTRY" traffic sign with corresponding indicia of its meaning depicted thereon forcing the player who lands thereon to turn from said elliptic-shaped peripheral portion of said path and enter said first branch which further reenforces the meaning of the traffic sign by having the player not only see the sign and its meaning, but also physically carry out its instruction; said elliptic-shaped peripheral portion of said path further including a second section extending clockwise from the twenty first space of said first section of said elliptic-shaped peripheral portion of said path, and being divided into 9 spaces; said path further including a second branch extending inwardly from, and forming with, the ninth space of said second section of said elliptic-shaped peripheral portion of said path a third junction, to, and forming with, the second space of said second section of said elliptic-shaped peripheral portion of said path a fourth junction, and being divided into 6 spaces; said third junction space having a "TURN RIGHT" traffic sign with corresponding indicia of its meaning depicted thereon forcing the player who lands thereon to turn right from said elliptic-shaped peripheral portion of said path and enter said second branch which further reenforces the meaning of the traffic sign by having the player not only see the sign and its meaning, but also physically carry out its instruction; said fourth junction space having a "DO NOT ENTER" traffic sign with corresponding indicia of its meaning depicted thereon forcing the player who lands thereon to turn from said elliptic-shaped peripheral portion of said path and enter said second branch which further reenforces the meaning of the traffic sign by having the player not only see the sign and its meaning, but also physically carry out its instruction; said path further including a third branch extending inwardly from, and forming with, the third space of said second branch of said path a fifth junction, to, and forming with, the sixth space of said first branch of said path a sixth junction, and being divided into 9 spaces; said fifth junction space having a "TURN LEFT" traffic sign with corresponding indicia of its meaning depicted thereon forcing the player who lands thereon to turn left from said second branch of said path and enter said third branch which further reenforces the meaning of the traffic sign by having the player not only see the sign and its meaning, but also physically carry out its instruction; said sixth junction space having a "NO RIGHT TURN" traffic sign with corresponding indicia of its meaning depicted thereon forcing the player who lands thereon to continue on said first branch and not enter said third branch which further reenforces the meaning of the traffic sign by having the player not only see the sign and its meaning, but also physically carry out its instruction; said elliptic-shaped peripheral portion of said path further including a third section extending clockwise from the ninth space of said second section of said elliptic-shaped peripheral portion of said path, and being divided into 8 spaces; said elliptic-shaped peripheral portion of said path further including a fourth section extending clockwise from the eighth space of said third section of said elliptic-shaped peripheral portion of said path, and being divided into 2 spaces; said path further including a fourth branch extending inwardly from, and forming with, the eighth space of said third section of said elliptic-shaped peripheral portion of said path, a seventh junction, to, and forming with, the second space of said third section of said elliptic-shaped peripheral portion of said path an eighth junction, and being divided into 7 spaces; said seventh junction space having a "TURN RIGHT" traffic sign with corresponding indicia of its meaning depicted thereon forcing the player who lands thereon to turn right from said elliptic-shaped peripheral portion of said path and enter said fourth branch which further reenforces the meaning of the traffic sign by having the player not only see the sign and its meaning, but also physically carry out its instruction; said eighth junction space having a "NO LEFT TURN" traffic sign with corresponding indicia of its meaning depicted thereon forcing the player who lands thereon to continue on said elliptic-shaped peripheral portion of said path or enter said fourth branch which further reenforces the meaning of the traffic sign by having the player not only see the sign and its meaning, but also physically carry out its instruction; said path further including a fifth branch extending inwardly from, and forming with, the second space of said fourth section of said elliptic-shaped peripheral portion of said path a ninth junction, to, and forming with the third space of said fourth branch of said path a tenth junction, and being divided into 9 spaces; said ninth junction space having a "25 MPH MAXIMUM SPEED LIMIT" traffic sign with corresponding indicia of its meaning depicted thereon forcing the player who lands thereon to slow down; said tenth junction space having a "TURN LEFT" traffic sign with corresponding indicia of its meaning depicted thereon forcing the player who lands thereon to turn left and enter the fourth branch which further reenforces the meaning of the traffic sign by having the player not only see the sign and its meaning, but also physically carry out its instruction; said elliptic-shaped peripheral portion of said path further including a fifth section extending clockwise from the second space of said fourth section of said elliptic-shaped peripheral portion of said path to said single start space of said first section of said elliptic-shaped peripheral portion of said path, and being divided into 8 spaces, with the eighth space being a single finish for use by all players; said path further including a sixth branch extending inwardly from, and forming with, the fourth space of said fifth section of said elliptic-shaped peripheral portion of said path an eleventh junction, and being divided into 5 spaces; said eleventh junction space having an "ADVANCE WARNING OF NO THROUGH ROAD" traffic sign with corresponding indicia of its meaning depicted thereon forcing the player who lands thereon to continue on said elliptic-shaped peripheral portion of said path and not enter said sixth branch which further reenforces the meaning of the traffic sign by having the player not only see the sign and its meaning, but also physically carry out its instruction.

2. The game as defined in claim 1, wherein said traffic sign is selected from the group consisting of "25 MPH Maximum Speed Limit," "35 MPH Maximum Speed Limit," "No entry," "No Waiting," "Children Playing," "Pedestrian Crossing," "Road Work," "No Right Turn," "No Left Turn," "No U Turn," "Yield Right Of Way," "Stop And Give Way," "Turn Right," "Turn Left," "Advance Warning Of No Through Road," "One-Way Street," "Sharp Deviation Of Route To Right," "No Left Turn," "No Parking," "Traffic Signal," "Keep Left," "Ahead Only," and "Do Not Enter."

3. The game as defined in claim 1, wherein said single deck of cards constitutes 80 cards, 6 of which having "If in a 35 MPH speed zone, drive two street blocks" instruction indica thereon, 5 of which having "Drive to second 35 MPH Maximum Speed Limit sign, if none drive one street block" instruction indica thereon, 4 of which having "Drive to third 35 MPH Maximum Speed Limit sign, if none drive two street blocks" instruction indica thereon, 4 of which having "If in a 35 MPH speed zone, stop at first 25 MPH Maximum Speed Limit sign" instruction indica thereon, 2 of which having "If in a 35 MPH speed zone, drive three street blocks" instruction indica thereon, 1 of which having "Drive to second 35 MPH Maximum Speed Limit sign, if none drive two street blocks" instruction indica thereon, 5 of which having "Drive to first 35 MPH Maximum Speed Limit sign" instruction indica thereon, 6 of which having "Drive to first 25 MPH Maximum Speed Limit sign" instruction indica thereon, 5 of which having "Drive to second 25 MPH Maximum Speed Limit sign" instruction indica thereon, 3 of which having "Drive to third 25 MPH Maximum Speed Limit sign" instruction indica thereon, 4 of which having "Drive to third 25 MPH Maximum Speed Limit sign, if none drive two street blocks" instruction indica thereon, 2 of which having "If in a 25 MPH speed zone, drive three street blocks" instruction indica thereon, 5 of which having "Drive to third 25 MPH Maximum Speed Limit sign, if none drive one street block" instruction indica thereon, 4 of which having "Drive to second 25 MPH Maximum Speed Limit sign, if none drive one street block" instruction indica thereon, 5 of which having "Drive three street blocks and stop" instruction indica thereon, 2 of which having "If in a 25 MPH speed zone, drive three street blocks" instruction indica thereon, 3 of which having "If in a 25 MPH speed zone, drive three street blocks and stop, else drive two street blocks" instruction indica thereon, 8 of which having "Drive one street block and stop" instruction indica thereon, and 6 of which having "Drive two street blocks and stop" instruction indica thereon.

* * * * *